US005655972A

United States Patent [19]

Heitzman

[11] Patent Number: 5,655,972

[45] Date of Patent: Aug. 12, 1997

[54] GOLF CHIPPING GAME

[76] Inventor: Patrick L. Heitzman, 1008 Second Ave. East, Shakopee, Minn. 55379

[21] Appl. No.: 596,520

[22] Filed: Feb. 5, 1996

[51] Int. Cl.[6] ..... A63B 69/36

[52] U.S. Cl. ..... 473/172; 473/193

[58] Field of Search ..... 473/196, 163, 473/165, 192, 197, 172, 164, 166, 170, 190, 193, 195

[56] References Cited

U.S. PATENT DOCUMENTS

| | | | |
|---|---|---|---|
| 1,469,130 | 9/1923 | Whitehair . | |
| 1,719,240 | 7/1929 | Scanlan . | |
| 1,763,243 | 6/1930 | MacFadden . | |
| 1,923,152 | 8/1933 | Kohn | 473/197 |
| 2,220,492 | 11/1940 | Piesco . | |
| 2,455,185 | 11/1948 | May . | |
| 3,037,776 | 6/1962 | Younce | 473/163 |
| 3,601,406 | 8/1971 | Giusti | 473/165 |
| 3,741,549 | 6/1973 | Wilson . | |
| 4,215,865 | 8/1980 | Pilati | 473/163 |
| 4,336,939 | 6/1982 | Krumlauf . | |
| 4,395,042 | 7/1983 | Boswell . | |
| 4,750,744 | 6/1988 | Michalec . | |
| 5,042,813 | 8/1991 | Huang . | |
| 5,492,319 | 2/1996 | Lee | 473/196 |

FOREIGN PATENT DOCUMENTS

| | | | |
|---|---|---|---|
| 2248189 | 4/1992 | United Kingdom | 273/181 R |

*Primary Examiner*—Mark S. Graham
*Attorney, Agent, or Firm*—Haugen and Nikolai, P.A.

[57] ABSTRACT

A golf game apparatus is used with a whiffle ball for a golf game enjoyable by both golfers and non-golfers. The golf game apparatus includes a movable tee with a generally rectangular structure. A target area is located several feet from the movable tee and has a plurality of targets representing golf holes. These targets include containers having varying diameters. The targets are positioned on different levels. A fairway structure extends from the target area towards the tee area. The player or players stroke the ball towards selected targets. The targets are assigned varying points, depending upon difficulty.

4 Claims, 4 Drawing Sheets

GOLF CHIPPING GAME

FIELD OF INVENTION

The present invention relates to a golf skill game and more particularly to a golf game directed to chipping skills which is of interest to all skills and ages of golfers or non-golfers.

BACKGROUND OF THE INVENTION

A variety of golf skill practice devices are present in the prior art. These usually consist of an upright structure with a variety of "targets", such as cups, apertures and the like arranged on the uprights structure. U.S. Pat. No. 1,719,240 discloses a golf game which has a vertical line of "targets" or flaps. The golf ball must hit the desired target with enough force to disengage the target. Some additionally include a golfing tee set away from the upright structure. All involve the use of a golf ball and golf club. Some of the devices are quite complex and include electronic score keeping which can be both expensive and bulky. For example, U.S. Pat. No. 4,336,939 discloses a golf game with electronic scoring. The square target is horizontally positioned with several scoring pockets. Others are collapsible, lightweight, and portable.

Several of the prior art devices have a plurality of pockets or apertures for receiving the golf ball. Examples can be found in U.S. Pat. No. 4,750,744 to Michalec, U.S. Pat. No. 4,395,042 to Boswell, U.S. Pat. No. 2,455,185 to May, U.S. Pat. No. 2,220,492 to Piesco and U.S. Pat. No. 1,469,130 to Whitehair. These patents try to replicate actual golfing situations and can be intimidating to non-golfers or inexperienced golfers. Therefore, what is needed is an enjoyable golf game that while adding an element not present in the game of golf, it still promotes a player's skill by requiring accuracy and consistency.

The present invention is a golf game which is directed to golfers or non-golfers of all skills and ages. It adds an additional challenge to golf chipping skills by using a whiffle ball instead of a golf ball. The whiffle ball reacts differently when hit with a golf club than a regular golf ball. However, the player must still strive to be accurate and consistent when stroking the ball. The game also utilizes a variety of sizes of "targets", which represents golf balls, into which the whiffle ball may be aimed. The game is designed for 18 rounds with each player hitting three times per round. The players are assessed by the number of points they obtain. Each target is assigned points and the points increase with the difficulty of hitting the whiffle ball into the specific target.

IN THE DRAWINGS

The foregoing features and advantages of the present invention will become apparent through those skilled in the art from the foregoing detailed description of preferred embodiment, especially when considered in conjunction with the accompanied drawings in which.

DETAILED DESCRIPTION OF THE PREFERRED EMBODIMENT

Figure 1:
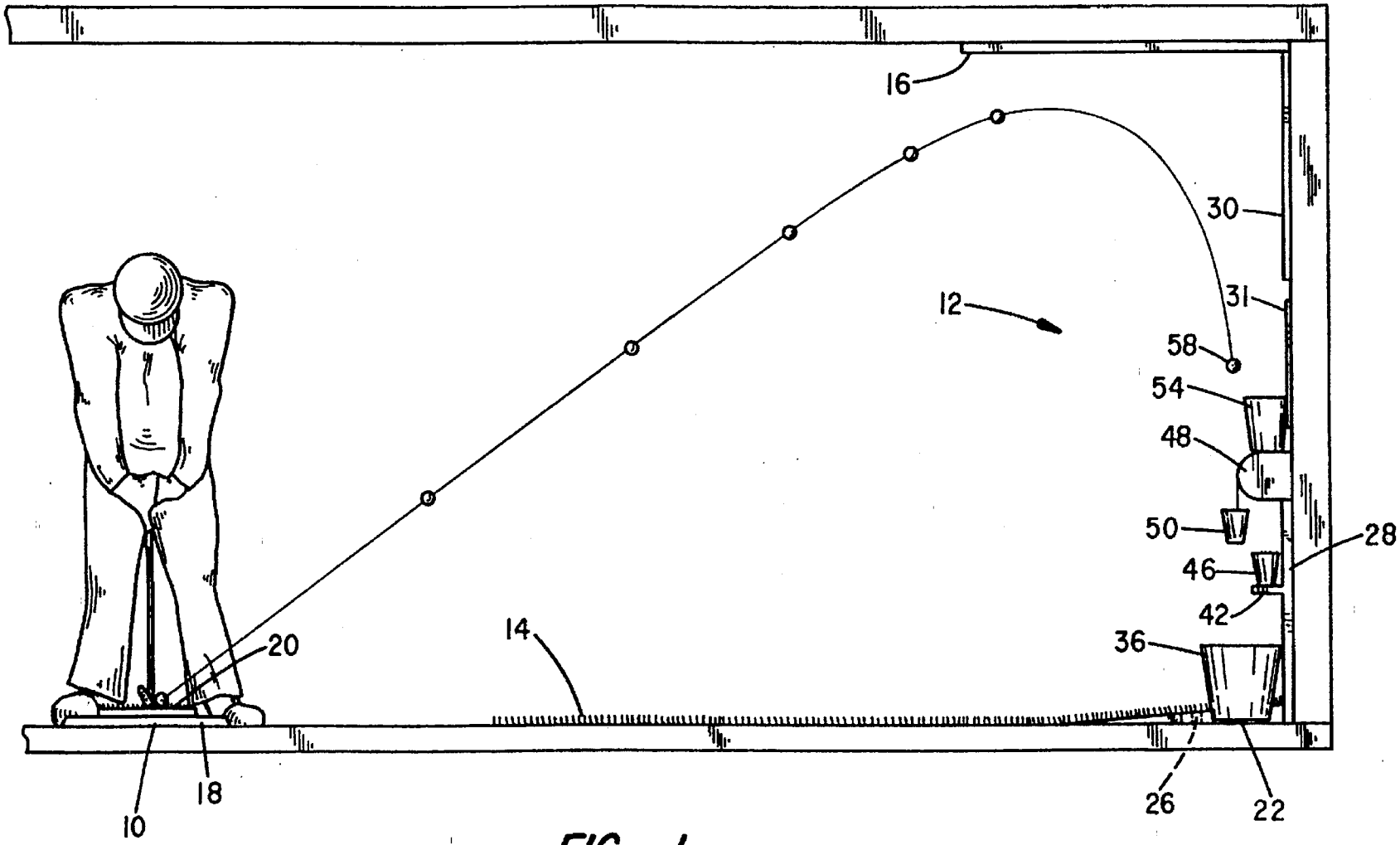
FIG. 1 is a side view of the present invention.

The present invention is shown in FIG. 1. It has a chipping tee 10 spaced apart from a golf hole simulation target area 12 with a fairway 14 positioned in front of the golf hole simulation target area 12. The fairway 14 extends from a slanted area adjacent the lower end of the target area. The golf hole simulation target area additionally includes an overhang 16. Each portion of the present invention will be discussed individually and then the playing of the game will be described.

Figure 2:
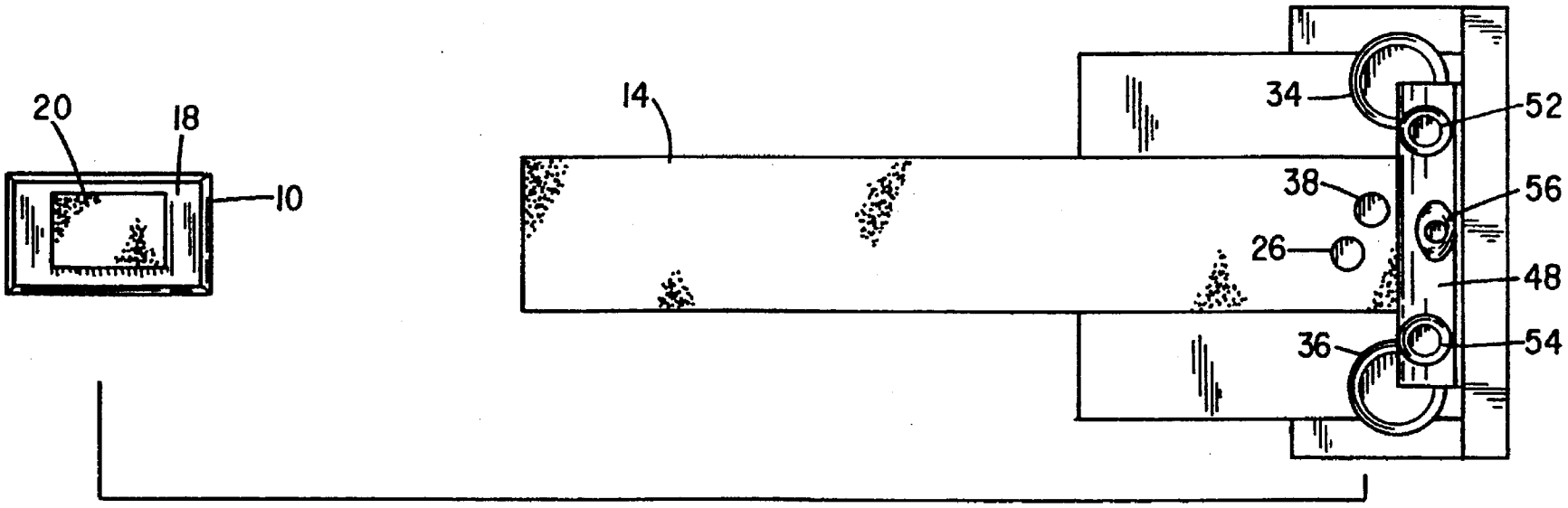
FIG. 2 is a plan view of the present invention.

The chipping tee 10, as seen in FIGS. 1 and 2, consists of a rectangular base 18, preferably made of rubber. The base 18 is preferably sized fourteen inches by twenty-four inches. A rectangular piece of astroturf® 20 is contained on the base. The astroturf 20 is ideally three-fourths inches high and is size nine inches by fourteen inches. The chipping tee 10 is spaced apart from the target area 12 by approximately twelve feet. The fairway 14 extends from the target area 12 towards the chipping tee 10. The fairway 14 and chipping tee 10 are separate components. This allows players to change the distance of the chipping tee 10 from the target area 12. The fairway 14, like the chipping tee 10, is made of astroturf® or any other comparable artificial turf. As stated earlier, the fairway 14 angles upwards adjacent the golf hole simulation target area 12. An angled foam or sponge base 22 is located beneath the fairway 14 to provide the angle. In the preferred embodiment, the fairway 14 has a flat area length of seventy-five and one half inches and an angled length of thirty-one and one half inches. The angled area 24 of the fairway 14 has one target which consists of a four inch diameter ground cup 26.

Figure 3:
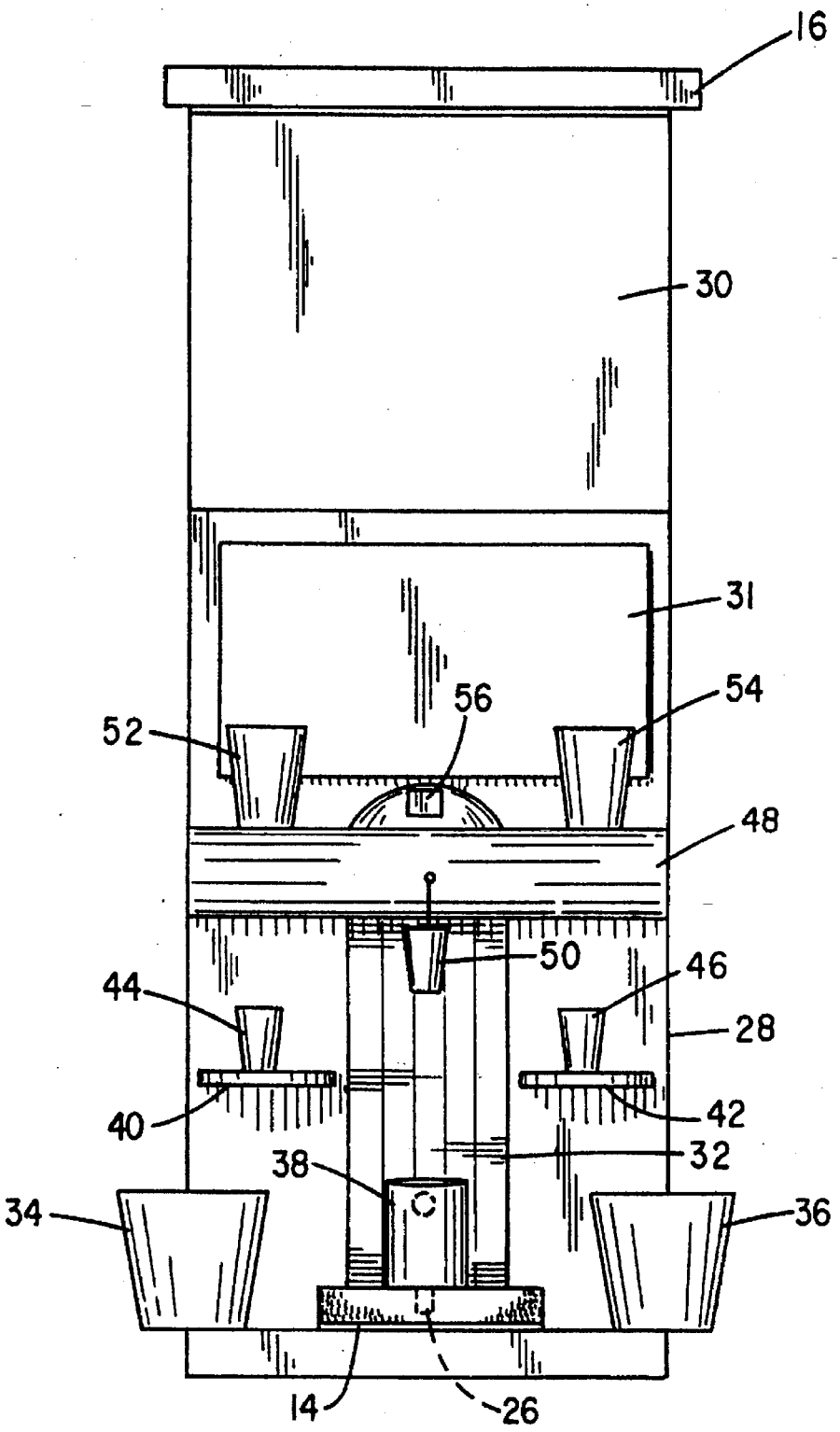
FIG. 3 is a front view of the golf hole simulation target area of the present invention.
Figure 4:
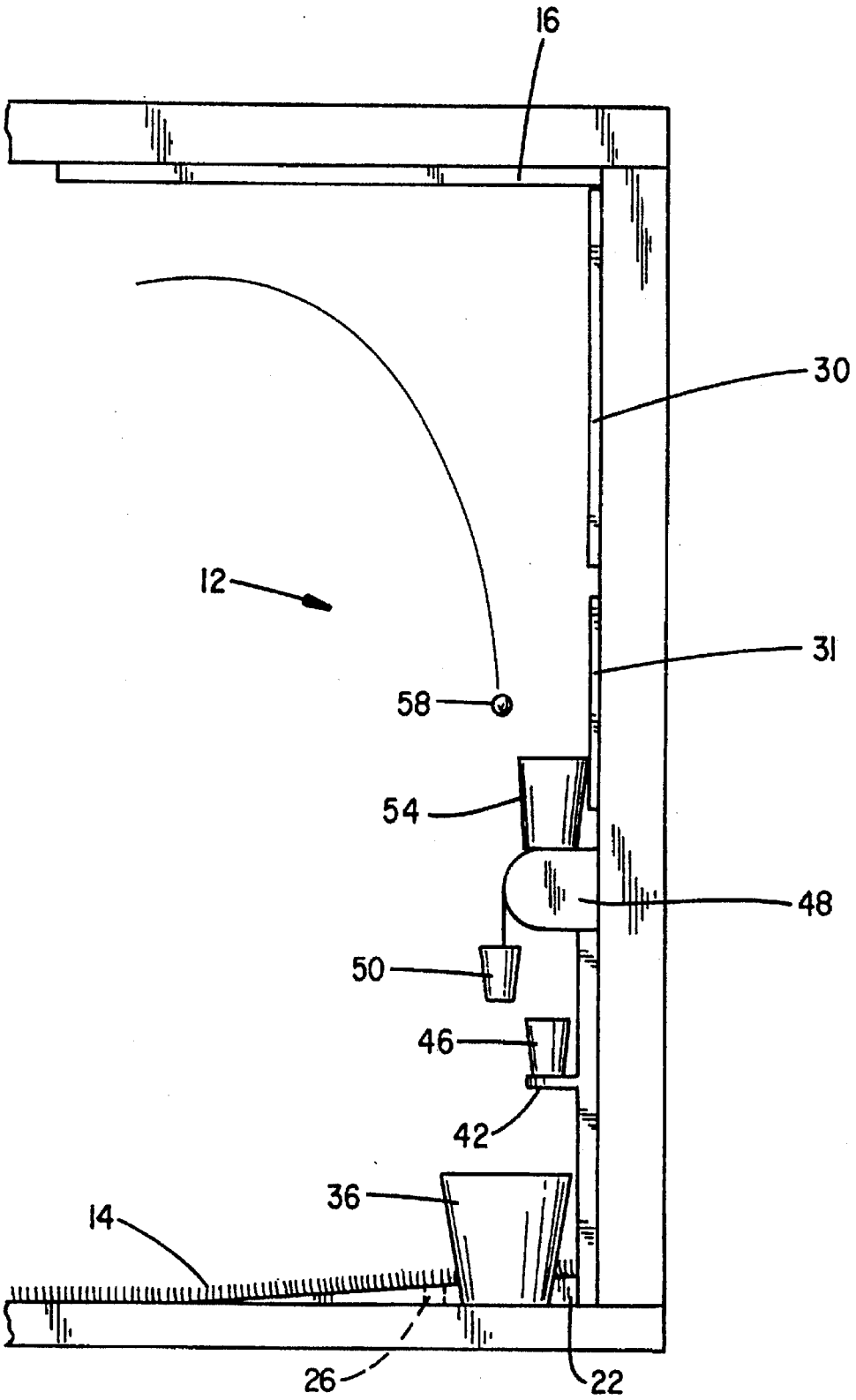
FIG. 4 is an enlarged side view of the golf hole simulation target area of the present invention.

The golf hole simulation target area 12 of this golf game has a lower portion 28 which contains the golf hole simulation targets as seen in FIGS. 1, 3 and 4. A soft board 30 is located above the golf hole simulation target area 12 with an area 31 for mounting a graphic or picture of a golf course, a famous golfer or other picture between the target area 12 and the soft board 30. The overhang 16 is covered with fabric which may be a hook and loop material available under the name Velcro®. The soft board 30, which is preferably thirty inches high, is preferably made of a resilient material.

The golf hole simulation target area 12 has a variety of receptacles and shelves. The lower portion 28 is wider than the fairway 14 and has a central lower padded area 32. The lower padded area 32 is approximately twelve inches and each opposing side is twelve inches with the entire golf hole simulation target area 12 being approximately three feet wide. These golf hole simulation targets will be described starting at the lowest levels. Identical buckets or like containers 34 and 36 are located on each side of the fairway 14. These buckets preferably have an eleven inch diameter. Secured to the lower padded area 32 and located at the top of the angled fairway area 24 is a six inch diameter cup 38. Approximately eighteen inches up from the floor or base two smaller shelves 40 and 42 are located on opposing sides of the lower padded area 32. Shelves 40 and 42 are each approximately ten inches wide and four inches deep. Each shelf 40 and 42 has a centered three and one half inch diameter cup designated 44 and 46. A third shelf 48 is located above the two smaller shelves 40 and 42. Shelf 48 extends along the width of the golf hole simulation target area 12 and extends approximately six inches from the top of the lower padded area 32. A two and one half inch diameter cup 50 is suspended from shelf 48, as seen in FIGS. 1, 3 and 4. On the top of the shelf 48 two six-inch diameter cups, 52 and 54 are located on the ends with a two and one-half inch diameter padded cup 56 positioned therebetween as seen in FIG. 1.

The game is played by using a small diameter whiffle ball and hitting it into the various containers or shelves. Points are attributed to each container. For example, the easier targets, such as the eleven inch diameter cups 34 and 36, the four-inch diameter ground cup 26 and the six-inch diameter cup 38 are worth one point each. The most difficult target, the hanging cup 50, is worth 25 points. The padded cup 56 is worth 15 points, with the six-inch cups 52 and 54 worth 10 points. The three and one-half inch diameter cups 44 and 46 on the two shelves 40 and 42 are worth 15 points with the shelves 40 and 42 themselves worth 10 points.

In an alternative embodiment, the Whiffle ball 58 may be covered with hook and loop material to correspond to the hook and loop material located on the overhang 16. The overhang 16 is considered an out-of-bounds area in the game and hence, if a ball is hit with too high of an arc, it will become stuck to the overhang 16 because of the hook and loop material.

The game consists of 18 rounds. Each player may hit three times per round. The player hits from the chipping tee which is located approximately four feet from the wall. However, it may be moved to change the distance from the chipping tee 10 to the golf hole simulation target area 12. The use of a whiffle ball 58 instead of a golf ball will require the player to readjust their golf stroke. The player will still need the accuracy and consistency of their strokes and thus will be able to carry these skills from the game course to the golf course.

While the above provides a full and complete disclosure of the preferred embodiment of the present invention, various modifications and equivalents will occur to those skilled in the art given the benefit of this disclosure, thus, the invention is not the specific embodiment described herein, but is defined by the appended claims.

What is claimed is:

1. A golf game apparatus comprising:

a. a positionable tee having a generally rectangular structure;

b. a target area having a plurality of golf hole simulation targets, said plurality of golf hole simulation targets comprising various apertures and positioned on a variety of levels;

a fairway structure extending from said target area to said movable tee;

d. a whiffle ball for stroking from said positionable tee to said target area, said whiffle covered with hook and loop material; and e. an overhang extending over said golf hole simulation target area, said overhang is covered with hook and loop material corresponding to said whiffle ball hook and loop material.

2. A golf game apparatus comprising:

a) a positionable tee having a generally rectangular structure:

b) a golf hole simulation target area having a plurality of golf hole simulation targets, said plurality of golf hole simulation targets comprising containers of varying diameter and positioned on different levels and said golf hole simulation target area including a backboard structure with a central vertical padded portion with an upper shelf extending the width of said golf hole simulation target area and two smaller shelves located beneath said upper shelf;

c) a whiffle ball; and d) a fairway structure extending from said golf hole, simulation target area, said fairway structure angled adjacent to said golf hole simulation target area whereby the players stroke the whiffle ball into a selected aperture of a golf hole simulation target.

3. A golf game apparatus of claim 2 and further including containers of varying diameter positioned on said shelves for stroking said whiffle ball into.

4. The golf game of apparatus of claim 3 wherein said whiffle ball is covered with hook and loop material and further including an overhang is covered with corresponding hook and loop material.

* * * * *